US009719339B2

(12) United States Patent
Richard et al.

(10) Patent No.: US 9,719,339 B2
(45) Date of Patent: Aug. 1, 2017

(54) REFRACTURING AN ALREADY FRACTURED BOREHOLE

(71) Applicant: BAKER HUGHES INCORPORATED, Houston, TX (US)

(72) Inventors: Bennett M. Richard, Kingwood, TX (US); Edward T. Wood, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 410 days.

(21) Appl. No.: 14/298,287

(22) Filed: Jun. 6, 2014

(65) Prior Publication Data

US 2015/0354334 A1 Dec. 10, 2015

(51) Int. Cl.

| | |
|---|---|
| ***E21B 43/26*** | (2006.01) |
| ***E21B 33/124*** | (2006.01) |
| ***E21B 43/116*** | (2006.01) |
| ***E21B 43/14*** | (2006.01) |
| ***E21B 33/12*** | (2006.01) |

(52) U.S. Cl.

CPC ..... *E21B 43/26* (2013.01); *E21B 33/124* (2013.01); *E21B 33/1208* (2013.01); *E21B 43/116* (2013.01); *E21B 43/14* (2013.01)

(58) Field of Classification Search

CPC ..... E21B 43/26; E21B 43/14; E21B 33/124; E21B 33/1208; E21B 43/116; E21B 43/25; E21B 43/263; E21B 33/10; E21B 34/14

See application file for complete search history.

(56) References Cited

U.S. PATENT DOCUMENTS

| | | | | |
|---|---|---|---|---|
| 3,062,294 | A * | 11/1962 | Huitt | E21B 43/112 166/177.5 |
| 5,273,115 | A | 12/1993 | Spafford | |
| 2013/0118750 | A1 | 5/2013 | Gu et al. | |
| 2013/0146291 | A1 | 6/2013 | O'Malley | |
| 2013/0186625 | A1 | 7/2013 | O'Malley | |
| 2015/0000936 | A1* | 1/2015 | Nguy | A61K 9/0085 166/387 |

FOREIGN PATENT DOCUMENTS

| | | | |
|---|---|---|---|
| WO | 2013154727 | A2 | 10/2013 |

* cited by examiner

*Primary Examiner* — Yong-Suk (Philip) Ro
(74) *Attorney, Agent, or Firm* — Steve Rosenblatt

(57) ABSTRACT

A well with existing perforations is re-fractured by positioning isolators at locations offset from the existing perforations and perforating through those isolators. The isolators are part of a bottom hole assembly that can be delivered on coiled or rigid tubing. The initial fractures can be straddled by the isolators with no mandrel openings between them to effectively isolate the existing perforations as new perforations take place through the isolators. The elements of the isolators can have internal gaps to allow for axial shifting after perforation that is thermally induced. The gaps assure remaining alignment with the new perforations despite some axial shifting. The bottom hole assembly can alternatively have an anchor to resist thermally induced forces that can cause axial shifting.

20 Claims, 3 Drawing Sheets

REFRACTURING AN ALREADY FRACTURED BOREHOLE

FIELD OF THE INVENTION

The field of the invention is creating new fractures in previously fractured boreholes in locations offset from the existing fractures.

BACKGROUND OF THE INVENTION

Wells that have been initially perforated and then the perforations fractures eventually experience a falloff in production or start to produce sand, water or other undesirable materials. In an effort to salvage additional production from such wells, past techniques have involved sealing off the perforations and perforating the borehole wall in other locations. The plugging of the existing perforations was done with chemicals that get into the perforations and solidify or harden to close them off. The problem with such systems is the uncertainty of distribution of the material which could leave some of the existing perforations open. Another way of closing the existing perforations is to have adjacent sliding sleeves that could be moved with a shifting tool to close the existing perforations. Some issues with this method are high initial cost, the cost of the trip to operate the sleeves and the uncertainty of whether the sleeves will actually shift to a closed position or get hung up on spurs or burrs caused by the original perforating. Other ideas have included sleeve placement over existing perforations but such a method has associated costs of placing the sleeves and some uncertainties that the placement location will cover the intended perforations and even if there is coverage of the intended perforations whether the cover will be effective as a seal to close off such openings.

The uncertainties of past methods are addressed by the present invention where a string of isolators straddles the existing perforations and where no openings in the mandrel between the isolators are to be found. In this manner the existing perforations are effectively isolated so that new perforations can be made by then perforating from within the mandrel and through the isolators to open new perforations that remain isolated from the existing perforations by virtue of the fact that the new perforations were started through the isolators. The bottom hole assembly can be delivered on coiled tubing or rigid pipe and can feature an anchor to prevent axial shifting due to borehole thermal effects. Such shifting could result in closing of the newly made perforations. An alternative way to address axial shifting is to provide internal spaces in each seal assembly so that even if there is axial shifting after firing there will still be enough new perforations aligned with such spaces in the barrier element so that adequate flow rates can be obtained without undue pressure drop.

Perforating through cement inflatable packers for initial well production has been discussed in Suman USRE 30711.

The above described features and others will be more readily apparent from a review of the description of the preferred embodiment and the associated drawings while recognizing that the full scope of the invention can be determined from the appended claims.

SUMMARY OF THE INVENTION

A well with existing perforations is re-fractured by positioning isolators at locations offset from the existing perforations and perforating through those isolators. The isolators are part of a bottom hole assembly that can be delivered on coiled or rigid tubing. The initial fractures can be straddled by the isolators with no mandrel openings between them to effectively isolate the existing perforations as new perforations take place through the isolators. The elements of the isolators can have internal gaps to allow for axial shifting after perforation that is thermally induced. The gaps assure remaining alignment with the new perforations despite some axial shifting. The bottom hole assembly can alternatively have an anchor to resist thermally induced forces that can cause axial shifting.

DETAILED DESCRIPTION OF THE PREFERRED EMBODIMENT

Figure 1:
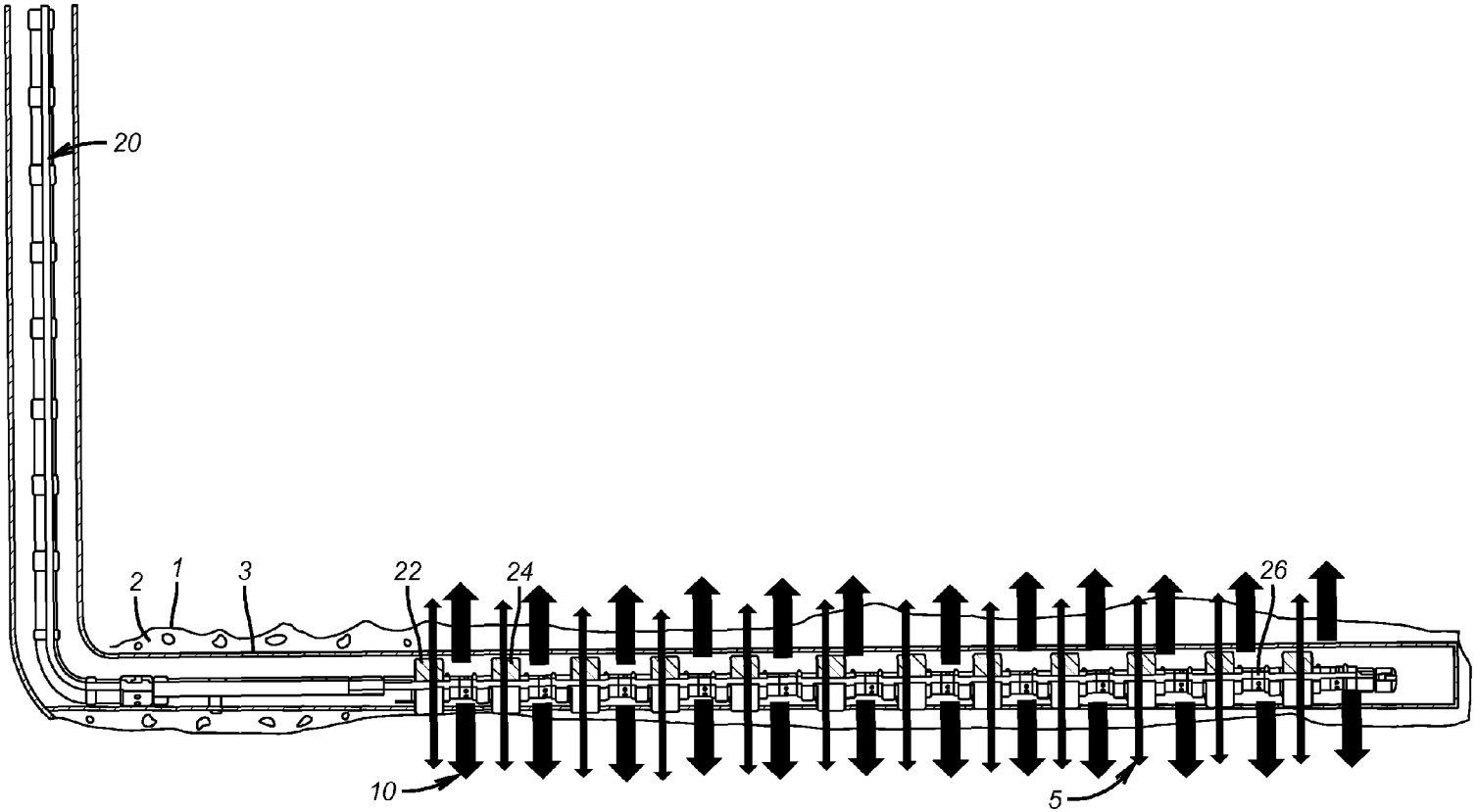
FIG. 1 is a schematic overview of the existing and new perforations that are offset from each other.

FIG. 1 shows a borehole 1 that is cemented with cement 2 although an open hole is also contemplated. The wide arrows 10 represent the original perforations in the borehole 1 and the narrower arrows 5 represent the recompletion perforations that are offset from the original perforations represented by arrows 10. The delivery string can be coiled or threaded tubing 20 that further includes a series of spaced isolators such as 22 and 24. Narrow arrows 5 are shown as going through the isolators such as 22 and 24. Intervals such as 26 preferably have no openings so that the openings represented by wide arrows 10 are effectively isolated when the new perforations represented by arrows 5 are put into service for production or injection. Optionally, the existing perforations represented by arrows 10 can be re-accessed after the creation and fracturing of the new perforations represented by arrows 5.

Figure 2:
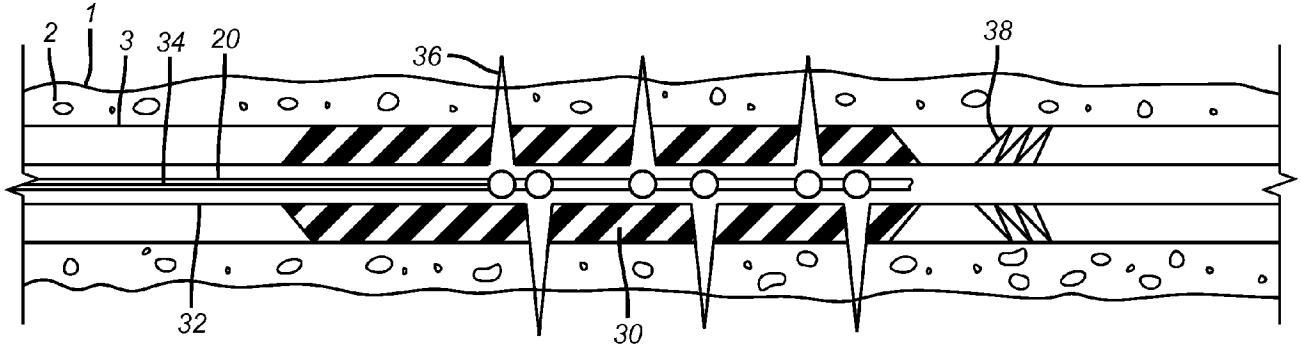
FIG. 2 is a view of an isolator with an anchor where the perforating is through the isolator.
Figure 3:
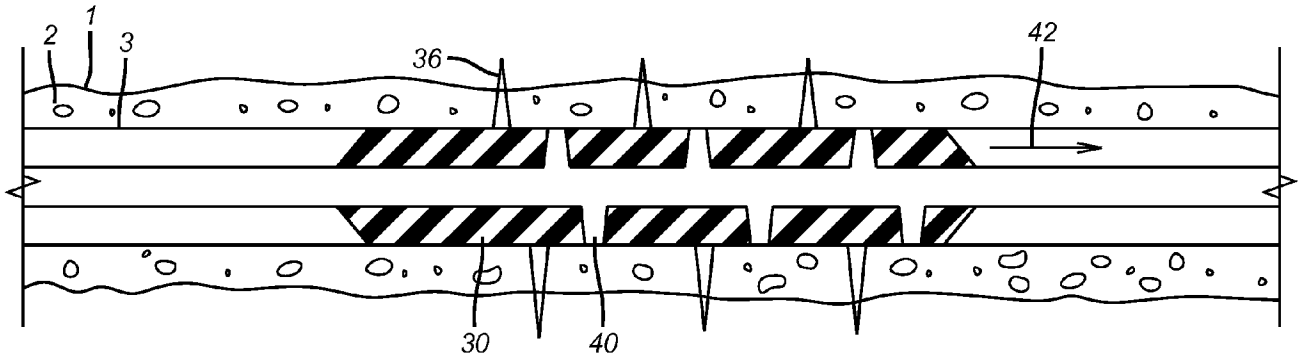
FIG. 3 shows a problem of misalignment after perforating that can happen due to thermally induced axial forces.

FIG. 2 illustrates a typical isolator 30 that can be a swelling packer or one that is set mechanically or hydraulically. The isolator 30 is supported on a mandrel 32 that is at the end of tubing 20. A gun 34 can be positioned within the mandrel 32 adjacent to one or more isolators 30 with the idea that the perforations 36 are created through the element 30. One or more anchors 38 can be provided adjacent one or more isolators 30. The anchor can be a known construction and is used to prevent or limit axial movement after perforation through the isolator 30 which could cause a misalignment between the openings made in the isolator 30 and in the formation. This possibility is illustrated in FIG. 3 where there is no anchor 38 and thermal loads have resulted in shifting of the perforated isolator 30 so that openings 40 made with the gun that was shot earlier are now axially offset from the perforations 36 that were newly made. Arrow 42 illustrates the thermally induced axial movement that can cause the misalignment shown in FIG. 3.

Figure 4:
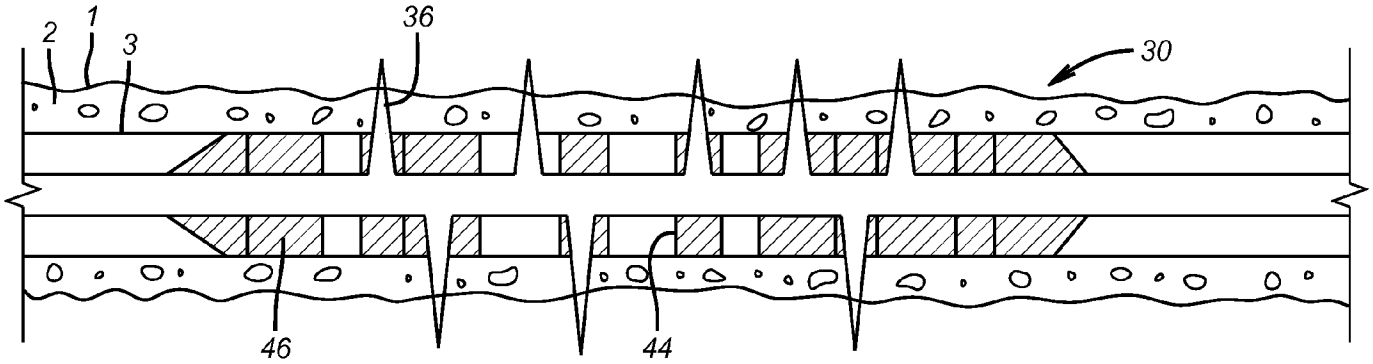
FIG. 4 shows gaps in the isolator element that allow for some thermally induced axial shifting while still maintaining alignment to the new perforations.
Figure 5:
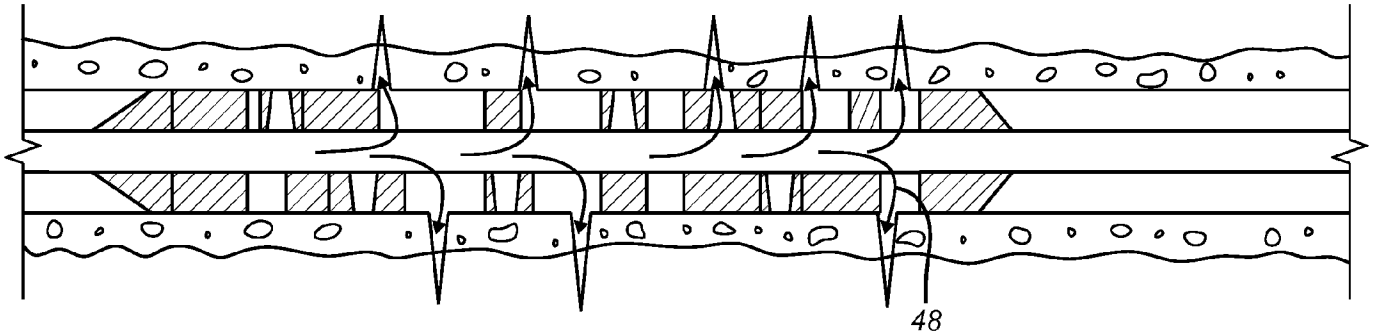
FIG. 5 is the view of FIG. 4 showing the alignment that still exists despite thermally induced axial shifting when no anchor is employed.

FIG. 4 is an alternative embodiment where at least one anchor such as 38 is not employed but provisions are made to have passages such as 44 preformed in the isolator 30 so that the firing of the gun is through the solid segments 46 to create the perforations 36. Arrows 48 in FIG. 5 show that paths to the perforations 36 still exist despite thermally induced axial shifting of the mandrel 32 there are still open paths to the formation 36.

Those skilled in the art will now appreciate that the perforating through the isolators will allow the new perforations to be in direct communication with the mandrel for the isolator so that production or injection can take place with the existing perforations isolated. The fracturing of the new perforations preferably takes place with the existing perforations isolated. However, after such fracturing the original perforations can be reopened with sliding sleeves in the mandrel for the isolators or by further perforating or by other methods to open access to the original perforations. It is preferred to isolate the original perforation during the fracturing of the new perforations so that all the fracturing fluid can go where most needed into the new perforations. The isolators can be anchored against thermally induced forces that can shift the already perforated isolator elements from the freshly made formation perforations. Alternatively the axial movement can be tolerated and the element for the isolators can be built with enough gaps that are presented in a repeating or random spacing pattern so that even after shooting through the solid portions of the isolator and tolerating later shifting of the isolator in an axial direction there will still be open paths to the formation perforations through the left open portions of the isolator. The open portions of the isolator are preferably internal to the isolator assembly so that if there is axial shifting and flow though the isolated openings in the element that there will be portions of the element to define closed paths to the newly made perforations.

The above description is illustrative of the preferred embodiment and many modifications may be made by those skilled in the art without departing from the invention whose scope is to be determined from the literal and equivalent scope of the claims below:

We claim:

1. A completion method for a previously operating borehole with openings into a surrounding formation, comprising:

actuating against a wall defining the previously operating borehole at least one isolator on tubing at a predetermined location of at least one said opening into the surrounding formation;

fluidly isolating from said tubing at least one existing opening on the wall with said isolator due to said actuating;

creating and leaving open at least one new perforation through said isolator; producing fluid into said tubing from and said new perforation.

2. The method of claim 1, comprising:

anchoring said isolator against axial shifting.

3. The method of claim 1, comprising:

providing at least one internal axial gap in said isolator in fluid communication with a mandrel supporting said isolator.

4. The method of claim 3, comprising:

providing a plurality of axial gaps as said at least one gap in said isolator;

creating a plurality of new perforations as said at least one perforation through said isolator;

allowing flow between said tubular and said new perforations through said at least one isolator through said gaps.

5. The method of claim 4, comprising:

spacing said gaps equally or unequally.

6. The method of claim 1, comprising:

using at least one perforating gun within a mandrel of said at least one isolator to produce said at least one new perforation.

7. The method of claim 1, comprising:

using a swelling packer or a mechanically or hydraulically actuated packer as said isolator.

8. The method of claim 1, comprising:

using coiled or rigid tubing for said tubular.

9. The method of claim 1, comprising:

fracturing said new perforation.

10. The method of claim 9, comprising:

reopening said existing perforation after fracturing said new perforation.

11. The method of claim 10, comprising:

flowing fluid to said existing and new perforations at the same time.

12. The method of claim 1, comprising:

using said isolator to shield said new perforations from borehole fluids.

13. The method of claim 1, comprising:

fracturing said new perforation.

14. The method of claim 13, comprising:

reopening said existing perforation after fracturing said new perforation.

15. The method of claim 14, comprising:

flowing fluid to said existing and new perforations at the same time.

16. The method of claim 15, comprising:

spacing said gaps equally or unequally.

17. A completion method for a previously operating borehole with openings into a surrounding formation, comprising:

actuating at least one isolator from a tubing supported bottom hole assembly;

initially isolating from said tubing at least one existing opening with said isolator;

creating at least one new perforation through said isolator;

flowing fluid between said tubular and said new perforation;

allowing said isolator to axially shift in response to thermal loading.

18. The method of claim 17, comprising:

providing at least one internal axial gap in said isolator in fluid communication with a mandrel supporting said isolator.

19. The method of claim 18, comprising:

providing a plurality of axial gaps as said at least one gap in said isolator;

creating a plurality of new perforations as said at least one perforation through said isolator;

allowing flow between said tubular and said new perforations through said at least one isolator through said gaps.

20. A completion method for a previously operating borehole with openings into a surrounding formation, comprising:

actuating at least one isolator from a tubing supported bottom hole assembly;

initially isolating from said tubing at least one existing opening with said isolator;

creating at least one new perforation through said isolator;

flowing fluid between said tubular and said new perforation;

using a plurality of spaced isolators on a mandrel as said at least one isolator;

providing a plurality of existing perforations as said at least one perforation;

straddling said existing perforations with said isolators to preclude access to said tubular from said existing perforations.

* * * * *